US006279495B1

(12) United States Patent
Karidio et al.

(10) Patent No.: US 6,279,495 B1
(45) Date of Patent: Aug. 28, 2001

(54) METHOD AND APPARATUS FOR OPTIMIZING THE COMBUSTION AIR SYSTEM IN A RECOVERY BOILER

(75) Inventors: Ibrahim Karidio; Victor Uloth, both of Prince George; Klaus Weiss, Vancouver, all of (CA)

(73) Assignee: Pulp and Paper Research Institute of Canada, Pointe Claire (CA)

( * ) Notice: Subject to any disclaimer, the term of this patent is extended or adjusted under 35 U.S.C. 154(b) by 0 days.

(21) Appl. No.: 09/609,668

(22) Filed: Jul. 3, 2000

(30) Foreign Application Priority Data

Oct. 22, 1999 (CA) ..... 2287205

(51) Int. Cl.[7] ..... F23G 9/02; F23G 7/04

(52) U.S. Cl. ..... 110/348; 110/213; 110/238; 110/297; 431/10

(58) Field of Search ..... 110/213, 233, 110/234, 342, 343, 345, 346, 347, 348, 238, 297; 431/175, 180, 9, 10

(56) References Cited

U.S. PATENT DOCUMENTS

| | | | | |
|---|---|---|---|---|
| 4,672,900 | * | 6/1987 | Santalla et al. | 110/264 |
| 5,022,331 | | 6/1991 | Simonen . | |
| 5,121,700 | | 6/1992 | Blackwell et al. . | |
| 5,195,450 | * | 3/1993 | Marion | 110/347 |
| 5,305,698 | | 4/1994 | Blackwell et al. . | |
| 5,450,803 | | 9/1995 | Svensk et al. . | |
| 5,771,817 | | 6/1998 | Olausson et al. . | |
| 5,809,913 | * | 9/1998 | Kramer et al. | 110/347 |
| 6,006,683 | * | 12/1999 | Janka et al. | 110/348 |
| 6,058,855 | * | 5/2000 | Ake et al. | 110/214 |

OTHER PUBLICATIONS

"Incinerator Overfire Mixing Study", pp. V1–6 and V1–7, prepared for the U.S. Environmental Protection Agency by Arthur D. Little, Feb. 1972.

M.W. Fridley and J.A. Barsin, "Upgrading the Combustion System of a 1956–Vintage Recovery Steam Generator", Tappi Journal 69(3), pp. 63–67, Mar. 1988.

A.K. Jones, P.J. Chapman and J. Mahaney, "Improved Air Port Arrangements for the Secondary Air Level", Proceedings of the 77$^{th}$ Annual Meeting of the Canadian Pulp & Paper Association Technical Section, pp. A123–A131, Jan. 1991.

M.W. Fridley and J.A. Barsin, "Upgrading a 1956–Vintage Recovery Steam Generator—II", Paper presented Jan. 28 and 29, 1988, 74$^{th}$ Annual Meeting Technical Section Canadian Pulp and Paper Association.

* cited by examiner

*Primary Examiner*—Henry Bennett
*Assistant Examiner*—K. B. Rinehart
(74) *Attorney, Agent, or Firm*—Swabey Ogilvy Renault

(57) ABSTRACT

A method and an apparatus for optimizing the combustion air system in a power boiler or chemical recovery boiler by improving fluid flow and gas mixing are disclosed, whereby one can increase boiler capacity and combustion uniformity and reduce particulate and gaseous emissions. The method involves interlacing of the secondary and, where applicable, the tertiary air supply through opposing air ports on all four walls of the boiler, and is implemented by alternately opening wide or partially closing a port damper on one side, while partially closing or opening wide a port damper on the opposite side, such that a 70–100% open damper on one side opposes a partially closed (10–40% open) damper on the other and vice versa in an alternating fashion, along opposing walls. In a preferred embodiment, the optimization is further enhanced by balancing primary air flow, achieved by adjusting port dampers and windbox pressures so that the primary air flow is evenly distributed between opposite walls, between all four walls of the boiler and between individual airports on each wall. Windbox pressure and other key measurements of boiler operation ensure proper balancing and an adequate interlacing of air flows at the primary, secondary and tertiary elevations, respectively.

32 Claims, 8 Drawing Sheets

Front

Front

METHOD AND APPARATUS FOR OPTIMIZING THE COMBUSTION AIR SYSTEM IN A RECOVERY BOILER

FIELD OF THE INVENTION

This invention is directed to a method and an apparatus for optimizing the combustion air system in power boilers. More particularly, the present invention pertains to a method and an apparatus for optimizing the combustion air system of a chemical recovery boiler in order to improve its efficiency.

The invention presented herein pertains to a method and an apparatus for optimizing the combustion air system in chemical recovery boilers found in pulp and paper mills employing a Kraff pulping process.

BACKGROUND OF THE INVENTION

In the pulp and paper industry, recovery boilers are used to burn spent liquor from the Kraft pulping process. The concentrated black liquor is burnt in the Kraft recovery boiler to regenerate sodium sulfide and sodium carbonate which is, in turn, converted to sodium hydroxide in a recausticizing plant. The produced white liquor, containing sodium sulfide and sodium hydroxide, is used in pulping wood. Organic matter that is dissolved in the pulping process is destroyed during combustion in the recovery boiler and the heat of combustion is recovered as steam. The steam is used to provide the mill's heat and energy requirements and/or to generate electricity for other uses.

The current practice for introducing combustion air into Kraft recovery boilers involves injection of the air at two or more elevations in the furnace cavity. Moving upward from the bottom or floor of the furnace, the air injection ports at succeeding elevations are referred to as primary, secondary, tertiary and quaternary air. All chemical recovery boilers have at least two levels of air injection. Newer boilers tend to have more levels. At each level, air is injected through port openings found on at least two opposing walls of the boiler. The port openings, which form the air jets, are usually rectangular. Dampers are typically provided to control the effective size of a port opening and the air pressure upstream of the port.

A need exists for a method and an apparatus for optimizing the combustion air system in chemical recovery boilers to improve boiler capacity and combustion uniformity. A need also exists for reducing particulate and gaseous emissions that are generated when the boiler is operating inefficiently.

Thus, an object of the present invention is to provide an optimized, combustion air supply system for a power or recovery boiler that can provide these improvements and eliminate or, substantially reduce operating problems. It is a further object of the present invention to provide an optimized combustion air system for older boiler installations, using existing combustion air ports to improve boiler efficiency and avoid costly boiler modifications. In another aspect of this invention, the optimized combustion air supply system would also be applicable to power boilers having two, three or more levels of combustion air, and can thus be applied in new and previously rebuilt recovery boilers. In yet another aspect, the optimized combustion air supply system would be especially applicable in a Kraft recovery boiler.

DESCRIPTION OF RELATED ART

Conventional combustion air systems in power boilers suffer from many deficiencies. Due to a lack of jet momentum, and because of interferences between colliding jet streams, as described by Adams et al in U.S. Pat. No. 5,305,698, and in other publications, conventional air systems invariably create a high velocity, upward flowing core somewhere in the furnace cross-section. This fast, upward flowing core is initiated at the primary air level and contains a high concentration of combustibles having a deficiency of oxygen for complete combustion. It can occupy a large percentage of the furnace cross-sectional area and can induce undesirable, recirculating flow patterns in the boiler as described in U.S. Pat. No. 5,305,698. This "chimney" causes an unnecessary carryover of liquor droplets and dry liquor particles, hindering gas mixing and delaying their combustion to higher levels in the furnace. Furthermore, portions of the char bed below the high velocity chimney are starved of liquor droplets and oxygen, thereby resulting in a generation of excessive, odorous, total reduced sulfur (TRS) gas, while the hotter regions of the bed generate excess sodium fume, contributing to plugging problems in the upper furnace.

Liquor droplets are sprayed from a higher elevation in the boiler, usually from at least one liquor nozzle or "gun" on each wall. These droplets dry and then begin to swell due to gas evolution from pyrolysis of the organic materials. As the dry liquor particles swell to a volume 20 to 30 times that of the original liquor droplet, their density decreases and they are readily entrained in this upward flowing core or "chimney" of air. In boilers with two levels of air entry below the liquor sprayers or guns, the introduction of secondary air from all four furnace walls is said to reinforce the detrimental updraft core phenomenon or "chimney effect", according to the teachings of U.S. Pat. Nos. 5,121,700; and 5,305,698.

Blackwell et al., U.S. Pat. No. 5,305,698 have shown that air introduced above the liquor level to break the strong upward flow of gas has little influence on the recirculating flow patterns and can seldom break the upward flowing gas core.

One of the major operational problems in Kraft recovery boilers is the formation of fireside deposits on the pendent heat transfer surfaces in the upper part of the boiler. The most troublesome deposits occur in the superheaters and the first part of the boiler bank. These deposits are formed mainly by particles that originate from the entrainment of some of the liquor spray particles in the upward flowing gases. The mass of a particle that can be entrained in a flowing gas varies proportionally to the sixth power of the gas velocity. From a conceptual point of view, it is, therefore, very important to minimize gas velocity extremes.

Deposit growth on the pendent heat transfer banks in the upper furnace is controlled using sootblowers. The sootblower lance tube (3 to 6inches in diameter) remains outside the boiler when not in service and is automatically inserted into the boiler and traversed across the boiler while being rotated. Sootblower length is usually about half the furnace width with sootblowers on opposite walls thus providing full width coverage between convection section heat transfer banks. High pressure, superheated steam is generally used as the blowing medium. Our studies have shown that sootblowers are completely ineffective in removing deposits caused by mechanical carryover of liquor particles. The best way to reduce carryover and furnace plugging is to reduce peak gas velocities in the lower boiler and the size of the upward flowing gas core.

A number of modifications to the Kraft recovery boiler combustion air system have been proposed and patented in attempts to overcome many of the deficiencies outlined above. Simonen, U.S. Pat. No. 5,022,331, proposed a secondary air system in which the hydraulic diameters of air ports in each of the four furnace walls increased from the corners of the furnace to the centers of each furnace wall. With this design, the degree of penetration of the respective air jets is said to increase as one moved from the corner to the center of each wall and the penetration of the air jets would be maintained constant under different loading conditions. Such an air system is very difficult and expensive to fabricate even when the larger ports are formed from the close grouping of smaller ports. Consequently, this proposal has never, to our knowledge, been implemented on a full-scale Kraft recovery boiler.

Svensk, U.S. Pat. No. 5,450,803, proposed a secondary air system in which the air was supplied to the furnace in such a way that the gas was forced to rotate in a plane substantially perpendicular to the longitudinal axis of the furnace. The so-called Rotafire™ air system counter-acts the so-called "chimney effect", but throws injected liquor outward against the walls of the boiler. Liquor can thus be deposited on the boiler walls where it will dry, pyrolyse and accelerate corrosion of the water wall tubes. In addition, higher temperatures on one side of the boiler are commonly reported by mills operating with a Rotafire™ air system, creating a condition that can accelerate water wall corrosion and plugging and, corrosion in the upper furnace heat transfer banks. While the hot side of the boiler can be changed by periodically reversing the direction of gas rotation, most boiler operators consider such a two-sided temperature distribution problematic.

Two-sided, temperature distribution is also common in boilers manufactured by Combustion Engineering (C E) or Asea Brown Bovari (ABB). In most of these boilers, secondary air in older boilers (with only two levels of air injection) and tertiary air in newer boilers is introduced tangentially into the boiler. This creates strong swirl, which stabilizes furnace flow patterns and increases the residence time for entrained liquor droplets in the hot lower furnace, thereby promoting a high degree of organic destruction. Unfortunately, tangential air is very difficult to balance. The swirling air often impinges on one of the boiler walls, depositing burning liquor droplets and creating a zone of high intensity combustion ("a hot spot"), that can greatly accelerate water wall corrosion rates, particularly if the water wall is fabricated using carbon steel tubes. Two-side temperature distribution can also persist into the upper boiler, aggravating plugging and corrosion problems in both the superheater and generating or boiler banks.

Olausson in U.S. Pat. No. 5,771,817 proposed a further modification of the RotafireTm air system in which the speed of rotation of the secondary air is increased by a constriction of the boiler at the tertiary air level. In addition, the tertiary air was injected with a rotation opposite that for the secondary air. The constriction at the tertiary air level reduces the cross-sectional area to approximately 70% of the area at lower levels in the boiler. While this modification might counter-act the negative flow features induced by the Rotafire™ air system, it was found to be prohibitively expensive.

In 1972, an Arthur D. Little report prepared for the U.S. Environmental Protection Agency on overfirm air systems for municipal waste incinerators introduced the idea of "interlacing" air ports to reduce air "jet deflection into the bed", and thereby minimize particulate loading in the flue gases. The report discussed two concepts for air jet arrangement. In one referred to as "full interlacing" in recovering boiler literature, the spacing of air ports on opposite walls of an incinerator would be offset so that air jets from one wall had an unhindered flow path to the opposite wall. As one moved from the front to the back of the incinerator on the center line of the furnace, air jets from the left and right side walls would provide the necessary combustion air in an alternating manner. The authors indicated, however, that "care must be given to the selection of jet operating characteristics to avoid penetration distances greater than the furnace width, as this could lead to slagging, fluxing and rapid refractory degradation". As an alternative, they suggested that one could use opposed jets on opposite boiler walls and monitor particulate entrainment and air jet velocities. In this way, the opposed jets could act to prohibit direct wall impingement.

Fridley, M. W. and Barsin, J. A.,"Upgrading the Combustion System of a 1956-Vintage Recovery Steam Generator", Tappi Journal, 69(3), pp. 63–67, March 1988, described modifications to an older CE-type boiler, to implement fully interlaced, unopposed air jets at the secondary air level, below the liquor spray guns. There was an apparent improvement in boiler operation, characterized by reduced carryover of dry liquor particles. In recent years, recovery boilers built or rebuilt by Babcock and Wilcox (B&W) have incorporated full interlacing of the air jets at the secondary air level. None of these designs, however, incorporate the concept of partially interlaced jets, wherein large jets oppose smaller jets.

Jones A. K, Chapman P. J. and, Mahaney J., "Improved Air Port Arrangements for the Secondary Air Level", Proceedings of the 77$^{th}$ Annual Meeting of the Canadian Pulp and Paper Association TechnicalSection, pp. A123–A131, January 1991, used both a ⅛$^{th}$ scale isothermal physical flow model and a computational fluid dynamic (CFD) model of a recovery boiler to evaluate a number of secondary air system designs for Kraft recovery furnaces. In all of the interlacing options evaluated in this study, secondary air was introduced from only two opposing side walls. The authors found that two of the proposed secondary air designs, fully interlaced jets and partially interlaced (big/small opposed) jets, produced gas flow patterns with improved mixing characteristics. They also reported significantly reduced peak velocities in the upward flowing central core, while reducing the percentage of the furnace cross-section that was in downflow. A slight offsetting of the nozzles in the big/small arrangement was reported to increase mixing at the secondary air level through the formation of counter-rotating vortices. In addition, from an operational standpoint, the big/small arrangement had apparent advantages in terms of consistency of operation and flexibility with respect to the interlaced design. Partially interlaced or big/small secondary air jets have subsequently been incorporated on recovery boilers that have been built or rebuilt by ABB—CE during recent years. In most of these boilers, the secondary air ports are all the same size and the big/small arrangement is affected by placing two ports close to each other on one wall, to form a big port, with a single, opposed port on the opposite wall.

Blackwell et al., U.S. Pat. No. 5,121,700, disclose the use of this big/small or partially interlaced air arrangement on Kraft recovery boilers. Their tests in a physical flow model showed that a partially interlaced secondary air system broke the "chimney" flow pattern of the conventional recovery boiler air system. There was a substantial improvement of the velocity profile with partial interlacing and partial interlacing was superior to full interlacing in providing a uniform velocity profile at the liquor spray level. In all of the air systems evaluated, secondary air was introduced from only two opposite walls of the boiler. In addition, it was stated (Column 12, lines 46–52) that, "with total interlacing or partial interlacing, it is important that no air is introduced at right angles to the interlacing pattern at that elevation. If air is introduced from ports in a third wall, or in a third and fourth wall at the same elevation, then there is a tendency to form an adverse, high velocity central upward draft core".

Blackwell et al., U.S. Pat. No. 5,30,698, disclosed the use of partially interlaced secondary and/or tertiary air with "two wall primary" air. In this concept, primary air is introduced through only two of the four boiler walls. The primary air flow is split equally between the two opposite walls, so the high velocity central core or chimney that results from a conventional four wall primary air system becomes a lower velocity, rectangle. The partially interlaced secondary air is then able to more effectively destroy the "central updraft", increasing gas mixing, improving boiler energy efficiency and the capacity to burn liquor from the pulping process. Notwithstanding, Blackwell et al. again teach, (column 17, lines 10–17), that all of the interlaced air must be introduced from two opposing walls only. Any air introduced from ports in a third or fourth wall at the same elevation will, according to their teachings, increases the tendency to form an adverse, high velocity central upward draft core. While several mills have run trials with two wall primary air, most mills find that they cannot put the required amount of primary air (40–70% of the total combustion air) into the boiler using ports on only two walls. When the primary air flow is too low, char bed temperatures decrease and odorous TRS gas emissions increase.

SUMMARY OF THE INVENTION

It is an object of the present invention to provide an optimized, combustion air supply system for a power or recovery boiler that can provide improvements and eliminate or substantially reduce operating problems.

It is a further object of the present invention to provide an optimized combustion air system for older boiler installations, using existing combustion air ports to improve boiler efficiency and avoid costly boiler modifications.

It is a further object of the invention to provide a novel recovery boiler.

In one aspect of the invention, there is provided a method of optimizing the combustion air system of a four wall recovery boiler having primary and secondary air flow elevations, said method comprising: a) introducing air flow at the primary and secondary elevations through air ports on all four walls of the boiler; and b) interlacing air flow at the secondary elevation by alternately opening wide and partly closing port dampers of said air ports on each wall to establish wide open air ports and partially open air ports, so that wide open dampers on one wall oppose partly closed dampers on the opposite wall.

In another aspect of the invention, there is provided a method of optimizing the combustion air system of a four wall recovery boiler having primary and secondary air flow elevations comprising: a) introducing air flow at the primary and secondary elevations through air ports in the four walls of the boiler; b) interlacing air flow at the secondary elevation by alternately opening wide and partly closing port dampers of said air ports on each wall to establish wide open air ports and partially open air ports, so that a wide open damper on one wall opposes a partly closed damper on an opposite wall; and c) completely closing one or more of said partially closed dampers at said secondary elevation to minimize size and peak velocity of a chimney flue.

In still another aspect of the invention, there is provided a recovery boiler adapted to be fired with spent liquor or biomass, comprising: a) four boiler walls and two or more elevations for air flow injection, including one at a primary level and one at a secondary level, defined between said walls; b) air ports in said walls at said primary level, of sufficient size to enable primary air flow to be distributed evenly between opposing walls and between all four walls; c) air ports of the same size and number on each wall and at each elevation having damper means to regulate air flow velocity and wiridbox regulating means to regulate air flow pressure; and d) openings in said boiler walls to enable one or more of the following measurements: i) cold air flow air velocity over a large cross-section of the boiler; ii) air flow through air ducts and windboxes at each elevation; iii) velocity and temperature of air flows in a furnace cavity of said boiler during auxiliary fuel firing; iv) velocity and temperature of air flows within the furnace cavity during liquor firing, and char bed temperature profiles; and v) temperatures at different elevations in the boiler.

In a particular embodiment of this latter aspect, the recovery boiler further includes at least one measurement probe in at least one of said openings, for said one or more measurements.

In a particular aspect of the invention, there is provided a method of optimizing the combustion air system of a four wall recovery boiler having primary and secondary air flow elements comprising: a) introducing air flow at the primary and secondary elevations through air ports on all four walls of the boiler, and b) interlacing air flow at the secondary elevations by alternate first and second air flows on each wall such that a first air flow from a wall opposes a second air flow from an opposite wall, wherein each second air flow is 10 to 50% of an opposing first air flow.

In a further particular embodiment, air flow is also introduced at a tertiary elevation of the boiler, through air ports on two opposed walls or on all four walls of the boiler; and the air flows at the tertiary elevation are interlaced as described for the air flows at the secondary elevation. Thus port dampers at the tertiary elevation are alternately opened wide and partly closed to establish wide open air ports and partially open air ports so that a wide open damper on one wall opposes a partly closed damper on an opposite wall. Additionally, one or more of the partially closed dampers at the tertiary elevation may be completely closed to minimize the size and peak velocity of the chimney flue.

In a further preferred embodiment employing the interlacing air flows at the tertiary elevations, first and second air flows alternate such that a first air flow from a wall opposes a second air flow from an opposite wall at said tertiary elevations.

In these latter embodiments the second air flow is suitably 10 to 50% of that of an opposing first air flow.

DESCRIPTION OF PREFERRED EMBODIMENTS

The present invention provides a method and apparatus for optimizing the combustion air supply system of a power or Kraft chemical recovery boiler by improving fluid flow and gas mixing in the boiler In this invention, the optimized combustion air supply system is applicable to power boilers and chemical recovery boilers having two, three or more levels of combustion air injection, and can thus be applied in new and previously rebuilt boilers.

In one embodiment of the invention, the method comprises interlacing air flow at the secondary and, where applicable, the tertiary elevation through opposed air ports on all four walls of a boiler in order to optimize the air supply system.

In another embodiment of the invention, the method comprises balancing air flow distribution at the primary elevation evenly between opposite walls, between all four walls and between individual air ports on each wall of the boiler.

In another embodiment of the invention, the method comprises balancing the primary air flow distribution and interlacing of the secondary and, where applicable, the tertiary air supply through opposed air ports on all four walls to optimize the combustion air supply system.

Data compiled from key measurements pertaining to boiler operation can be used to provide a comprehensive picture of the state of the air supply system, enabling a proper balancing of the primary air supply and an effective interlacing of secondary air, and, where applicable, tertiary air. Developed for evaluating the combustion air supply system in a recovery boiler and for improving its operation, each key measurement provides data that reflects a unique insight into the operation of the boiler. Compiled, the data provide a comprehensive picture of what is happening in the boiler, enabling means for effectively balancing the primary air supply and for interlacing air flow at the secondary and tertiary levels.

In accordance with the invention, it has been discovered that, contrary to the teachings and practice in the past and present state of the art, the combustion air supply system in a recovery boiler can be optimized by (a) introducing air flow at the primary and secondary elevations through air ports on all four walls of the boiler; and (b) interlacing air flow at the secondary and, where applicable, the tertiary elevations by alternately opening wide and partially closing port dampers on each wall so that wide open and partially closed dampers on one wall oppose respectively, partially closed and wide open dampers on the opposite wall.

In the context of the invention, in the case of boilers in which the air ports are of the same size, wide open dampers contemplates dampers which are 70 to 100% open to establish air ports which are fully open i.e. 70 to 100% open; and partially closed dampers contemplates dampers which are 10 to 40% open (i.e. 90 to 60% closed) to establish air ports which are partially closed i.e. 10 to 40% open (i.e. 90 to 60% closed).

"Interlaced" secondary air flow as referred to and employed in this invention comprises the steps of, alternately opening wide or partially closing the dampers on one wall, while partially closing or opening wide the dampers on the opposite wall, such that a wide open damper on one wall faces a partially closed damper on the other wall, in an alternating fashion on each wall of the four wall boiler.

According to one embodiment of the present invention, primary air flow is balanced by adjusting port dampers and windbox pressures so that the air flow is evenly distributed between opposing walls, between all four walls, and between individual air ports on each wall of the boiler at the primary elevation.

According to another embodiment, one or more of the partially closed dampers at the secondary and, where applicable, the tertiary elevations is closed completely in order to minimize the size and the peak velocity of a chimney flue.

In order to ensure adequate interlacing of the secondary and optional tertiary air in the "interlaced" secondary or tertiary air flows employed in this invention, the windbox pressure for a partially open port is suitably set at 10 to 70% of that for a wide open port, and preferably at 10 to 40% of that for a wide open port.

In order to attenuate strong interactions of primary air flow in the boiler corners, the air flow through one or more corner ports is preferably reduced or tapered by adjusting of the corner port dampers. Such corner ports are preferably those that are 6 to 8 feet from a corner or on the 1 or 2 windboxes closest to the corners of the boiler and the air flow through the remaining ports outside this range is set equal so that the flow is distributed as evenly as possible between opposing walls and between all four walls of the boiler.

According to a preferred aspect of the invention a method has been developed for optimizing the combustion air system in a recovery boiler comprising the steps of a) accurately balancing primary air flow distribution, and b) interlacing secondary and, where applicable, tertiary air flow through opposed ports on all four walls of the boiler employing the "interlaced" secondary air flow method described above In a boiler where the number of air ports at the primary elevation along the side walls differs in number from the ports on the front and rear walls, for example, a ratio of up to 2:1, the air flow through opposed walls and through individual air ports in each wall is set very nearly equal even though air flows are roughly proportional to the number of open air ports on each wall or to the relative length of each wall. This is especially so for rectangular boilers.

In boilers having opposed ports of different size or number, such as a two ports versus one arrangement in some existing boilers, the mass flow of air to the single port or the smaller port is adjusted to equal 10 to 50%, preferably 20 to 40%, of the air flow from the larger or double port. This same relationship applies to boilers having opposed ports of identical size, however, the relationship is also conveniently defined by reference to the wide open and partially open damper ports, described above.

In boilers having opposed ports of identical size, windbox pressure for a partially open port is set at 10 to 70%, preferably 20 to 40%, of the windbox pressure for the opposed "fully open" or large air port.

In accordance with the invention, it has been discovered, unexpectedly, that the air supply in existing recovery boilers having partially interlaced secondary air flow through opposed air ports of only two opposing walls was substantially enhainced and optimized by additionally interlacing the secondary air flow through opposed ports on the other two walls, employing the interlaced secondary air flow method described above. This was implemented by adjusting the dampers on each port, as described above, to minimize the size of any upward flowing, high velocity chimney and the peak gas velocities within the chimney. The effective size of and the air flow from each secondary air jet is calculated to permit a consideration of variables such as opening size, number of openings in groups of openings, air pressure upstream of the openings, or combinations thereof.

The combustion air supply system was further enhanced when the primary air flow was balanced by adjusting port dampers and windbox pressures so that the air flow was evenly distributed between opposing walls, between all four walls and between individual air ports on each wall of the boiler at said elevation.

To further optimize the combustion air supply system, five key measurements were developed to ensure that the air flow at the primary elevation is properly balanced and that the secondary and, where applicable, tertiary air flow is interlaced as taught in the present invention. These measurements were found necessary to ensure the optimization of the combustion air supply system in a Kraft recovery boiler even though there is great difficulty in making these measurements due to the harsh environment encountered in the recovery boiler. Each key measurement provided a different insight into the operation of the boiler and together the data provide a comprehensive picture of what was happening in the boiler, making further optimization of the combustion air supply system possible.

The five key measurements, which were developed and found critical in evaluating the combustion air system in a recovery boiler, are:

a) Cold flow velocity measurements. These give a detailed picture of the boiler velocity profile and furnace flow patterns. Velocities over a large cross-section of the furnace are measured using corner observation ports and larger liquor gun ports.

b) Boundary condition measurements. These explain why or where the air supply system is unbalanced and provide a check on the accuracy of the mill's instrumentation allowing an accurate calculation of the discharge coefficients at each air level. Boundary condition measurements include measuring the air flow through each air duct (primary, secondary, etc.) and through each individual windbox at each air injection level.

c) Velocity and temperature measurements during auxiliary fuel firing. These show the effect of air jet expansion due to higher furnace temperatures and any interactions that may result from air jet expansion.

d) Velocity and temperature measurements with liquor firing, which show the effect of both air jet expansion and the presence of the char bed.

e) Char bed temperature profiles and temperature measurements at different elevations in the boiler. These give an indication of how balanced the air and liquor spray distribution are and also indicate whether or not the air split between the different levels of air injection is adequate to produce the high char bed or lower furnace temperatures necessary for efficient recovery boiler operation.

The apparatus of this invention comprises a four walled recovery boiler having two or more elevations for air flow injection, one at a primary level and one at a secondary level wherein the ports are of sufficient size to enable primary air flow to be distributed evenly between opposing walls and between all four walls. The air ports are preferably of the same size and number on each wall and at each elevation and provide means to regulate air flow velocity and windbox pressure. Openings at various elevations enable one or more of the following measurements: cold flow air velocity over a large cross-section of the boiler, air flow through air ducts and windboxes at each elevation, velocity and temperature of air flows during auxiliary fuel firing, velocity and temperature of air flows during liquor firing, and char bed temperature profiles and temperatures at different elevations in the boiler.

In another aspect of the apparatus of this invention, the boiler is rectangular in shape and the total number of side wall air ports at the primary elevation is different from the number of front and rear wall ports and the air flow is evenly distributed between opposing walls, between individual air ports on each wall of the boiler and as evenly as possible between all four walls. Where the ratio of the number of ports on the side walls to the number of ports on the front and rear walls is 2:1 and each port is identical in size, the air flow through opposed walls and through individual air ports in each wall are set very nearly equal even though air flows are roughly proportional to the number of air ports on each wall or to the relative length of each wall. Preferably, the ratio is 1:1 and each port is identical in size.

BRIEF DESCRIPTIONS OF THE DRAWINGS

FIG. 1 is a contour plot of cold air flow velocity profile at the liquor gun level in a first typical recovery boiler;

FIG. 2*a* illustrates an interlaced secondary air arrangement in a second recovery boiler;

FIG. 2*b* is a contour plot of the cold air velocity profile at the liquor gun level in the second recovery boiler;

EXAMPLES

The efficacy of the present invention will now be illustrated by the following examples which should not be construed as limiting the scope thereof:

Example 1

Figure 1:
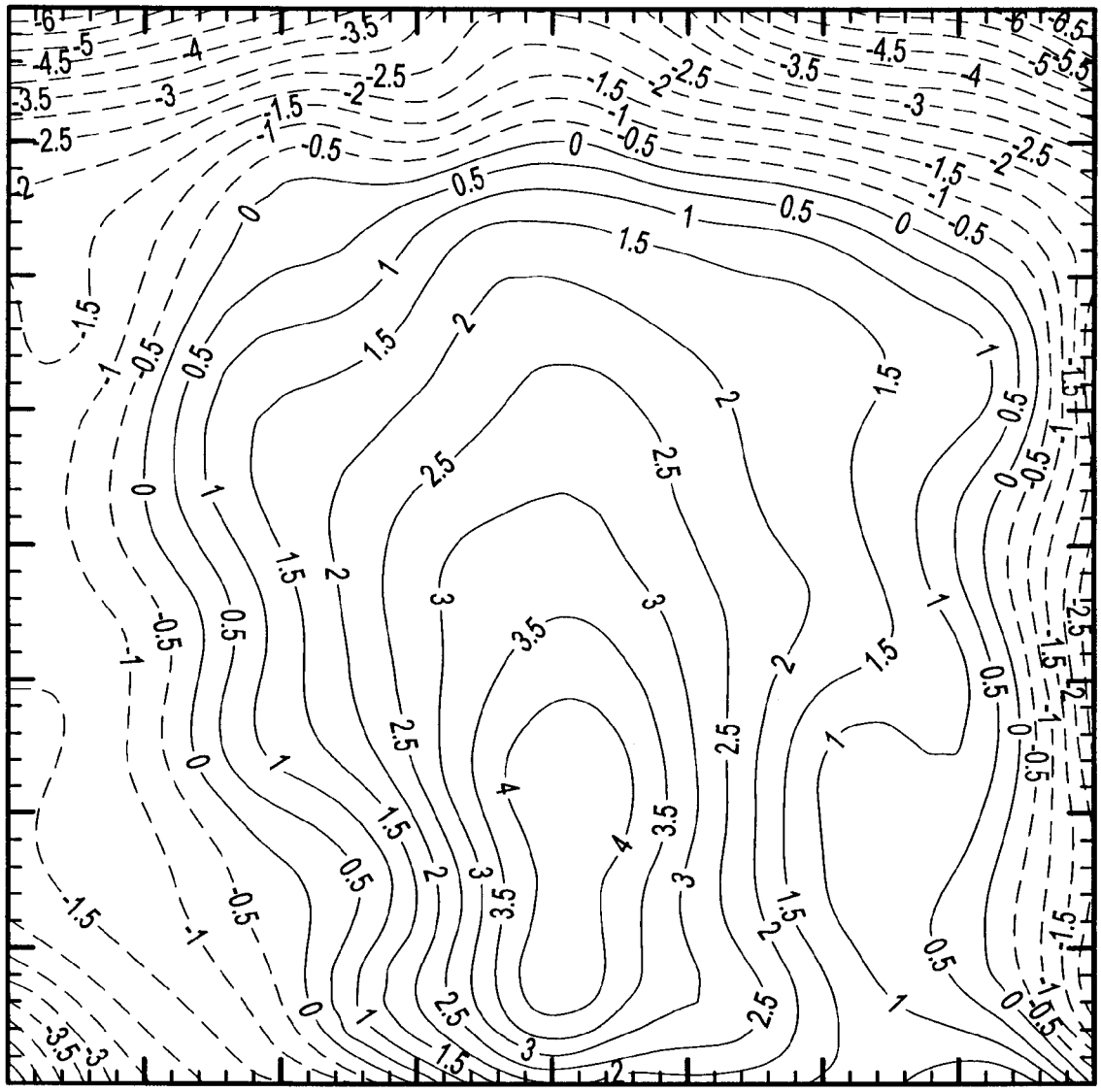

FIG. 1 illustrates a contour plot of the cold flow air velocity profile at the liquor gun level in a typical recovery boiler, "A", whose combustion air system is not optimized. The cold flow air velocities were measured with a standard hot wire anemometer and the flow direction was determined by both an electronic vane-type directional indicator and by visual observation of a mylar ribbon tied to a probe. A computer-based data acquisition system was used to record all air flow velocity data (magnitude and direction). In FIG. 1, a high velocity upward flowing core or chimney is evident adjacent to the front wall of the boiler and is displaced slightly towards the boiler's right wall. In this contour plot, areas with equal velocities are joined. In the areas between contour lines, measured velocities fall between those marked on the adjacent contours.

Boiler A was built in 1990 by Babcock & Wilcox and has a three level combustion air system. While there are three secondary air ports on each of the front and rear walls, most of the secondary air is injected though 12 pairs of fully interlaced ports on the boilers side walls. As illustrated in FIG. 1, the fully interlaced secondary air was unable to destroy the chimney flow pattern created at the primary air level. This was likely due to the location of the chimney in an area where only a few secondary air jets could act on it and the strength of the chimney due to the gross imbalances at the primary air level.

The resulting flow pattern had very detrimental effects on boiler operation. The location of the high velocity chimney adjacent to the liquor gun on the front wall of the boiler resulted in very high levels of liquor carryover. The boiler plugged rapidly and had to be taken out of service for water washing every 6 or 7 weeks. In addition, the unbalanced primary air created a region of strong downflow adjacent to the rear wall of the boiler. Liquor droplets from the two liquor nozzles on this back wall dropped rapidly to the char bed, often without completely drying. The smelt, which flowed from spouts on the rear wall of the boiler, was contaminated with excessive concentrations of unburnt carbon or dregs, which resulted in problems in subsequent green liquor clarification operations.

TABLE 1

Summary of air flow distribution in Boiler A before optimization.

| Wall | % of Primary Air | % of Secondary Air | % of Tertiary Air | % of Total Combustion Air |
|---|---|---|---|---|
| Front | 19.5 | 6.7 | 52.8 | 20.5 |
| Right | 26.0 | 54.7 | 0 | 31.0 |
| Rear | 26.8 | 9.6 | 47.2 | 24.6 |
| Left | 27.7 | 29.0 | 0 | 23.9 |
| % of Total Combustion Air | 54.0 | 31.0 | 15.0 | 100.0 |

By examining the air distribution data in Table 1, the reasons why the high velocity chimney is located in an undesirable position is quite evident. At the primary air level, air flow from the front wall of the boiler was only 73% of that from the rear wall; the much higher air flow from the boiler's rear wall is therefore responsible for pushing the chimney up against the boiler's front wall. However, since the air flow from the right wall at this level was only 94% of that from the left wall this also was partly responsible for pushing the high velocity chimney slightly towards the boiler's right wall.

Example 2

Figure 2B:
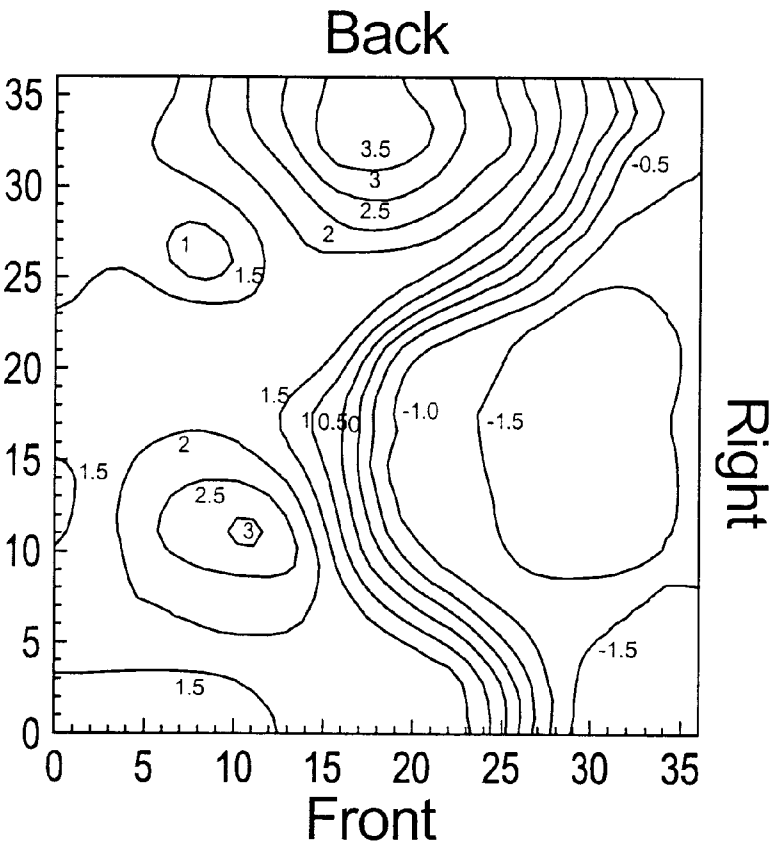
FIG. 2b (PRIOR ART)

FIG. 2*b* illustrates a contour plot of the cold air flow velocity profile at the liquor gun level in recovery boiler B. The air system in this boiler was optimized according to the teachings of Blackwell et al., (U.S. Pat. No. 5,121,700), with air flow from all four walls at the primary air level and from the two side walls only at the secondary air level. The secondary air jets were interlaced with large jets versus small, using the sidewall ports only. Load burners on the left and right walls of the boiler opposed each other and both load burners on the right wall were used as "fully open", large ports. The dampers on the other "fully open" ports were opened completely, while those on the "partially open" ports were all half-open. The resulting combustion air distribution between the walls of the boiler, and between the two levels of air injection, is summarized in Table 2. It is apparent that interlacing using this crude approach resulted in twice as much secondary air entering through the boiler's right wall as through the left, pointing out the need for accurate air flow measurements to detect such problems and to enable proper balancirg of air flow at all levels at which combustion air is introduced.

TABLE 2

Summary of air flow distribution in Boiler B following optimization, according to the teachings of Blackwell et al. (U.S. Patent 5,121,700).

| Wall | % of Primary Air | % of Secondary Air | % of Tertiary Air | % of Total Combustion Air |
|---|---|---|---|---|
| Front | 23.8 | 4.1 | 0 | 18.9 |
| Right | 25.9 | 62.8 | 0 | 35.1 |
| Rear | 23.0 | 2.0 | 0 | 17.8 |
| Left | 27.2 | 31.1 | 0 | 28.2 |
| % of Total Combustion Air | 75.2 | 24.8 | 0 | 100.0 |

Although this (prior art) air system configuration was found to reduce peak gas velocities in the high velocity chimney by 34%, compared to the conventional air arrangement on this boiler (without interlacing), it was responsible for creating an undesirable second chimney along the rear wall of the furnace. In addition, a tiny chimney remained along the diagonal from the front-left to back-right corner. This chimney was pushed toward the front left corner of the boiler by the unbalanced air flows at both the primary and secondary air levels. Negative velocities, indicative of downflow, remained along the right wall of the boiler, while everywhere else the velocity was around 2.0–2.5 m/s. It should be noted, however, that about 20% of the furnace cross-section was still in downflow. The strong downflow region along the boiler's right wall was induced by the very high secondary airflow through the right wall of the boiler.

The second chimney that was created along the back wall of the boiler could, in normal operation, easily create a high oxygen environment and a "hot spot" at the point of impingement on the back wall, resulting in increased water wall corrosion in this region. The location of this chimney adjacent to the liquor gun on the back wall of the boiler could also be expected to increase liquor carryover and boiler plugging rates, despite the overall general reduction in the size of the high velocity chimney. This indicates that extreme care is necessary in setting the secondary air port dampers to establish a partially interlaced arrangement and indicates the importance of accurate measurements to properly balance all levels at which combustion air is introduced.

Example 3

Figure 3:
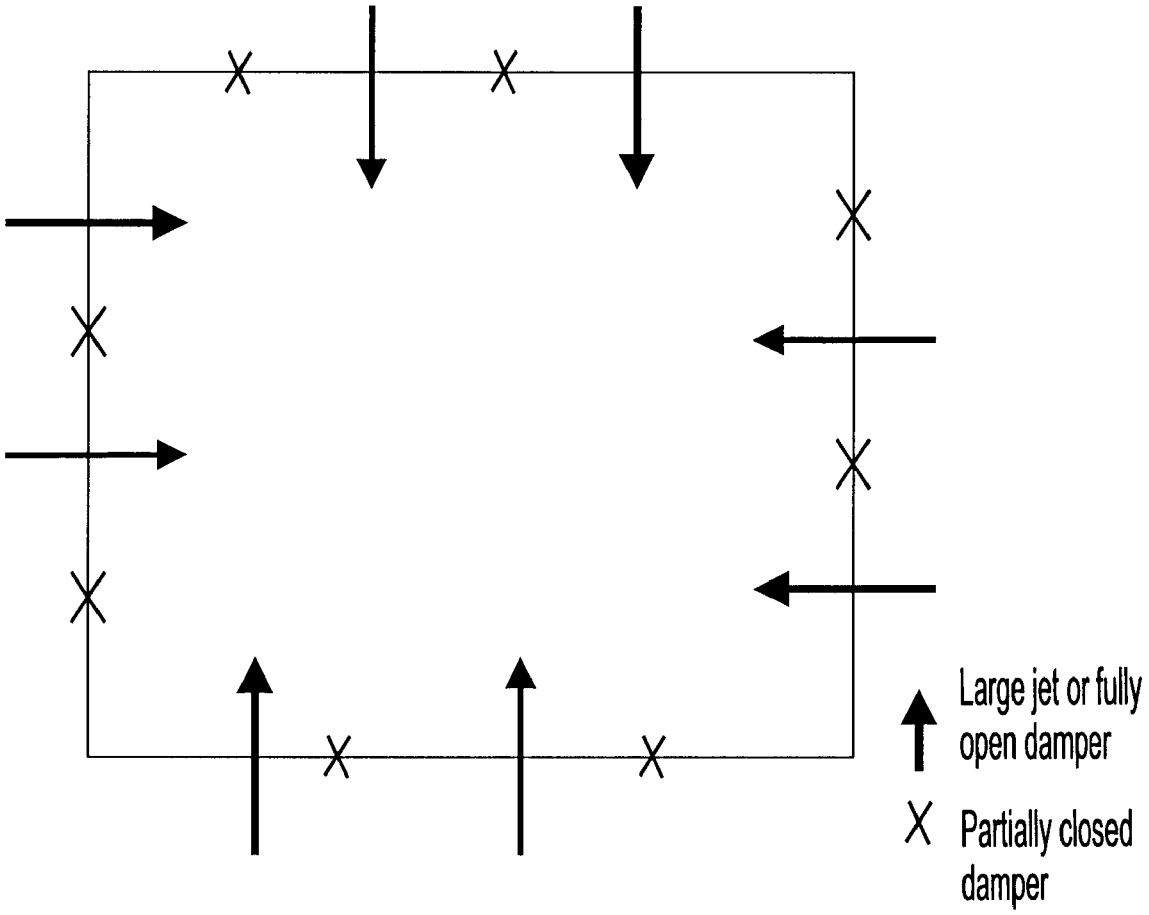
FIG. 3 illustrates partially interlaced secondary air from the four walls of a recovery boiler in accordance with the invention.

The inventors of the present invention have evaluated air flow patterns in a large number of recovery boilers and have discovered that the introduction of primary air from ports in all four walls invariably creates a high velocity, upward flowing core somewhere in the furnace cross-section. In this evaluation of the potential application of partial (big/small) interlacing of secondary air to reduce the size of the chimney and its peak gas velocities, it was observed that a large percentage of boilers lack the forced draft fan capacity to push the required secondary air flow through only two walls. As a result, contrary to all prior art teachings, the inventors decided to introduce secondary air from opposed ports on all four boiler walls, using the partially interlaced approach described earlier as "interlaced secondary air flow" distributing thE. secondary air equally from each of the four walls, as illustrated in FIG. 3. When the secondary air was distributed to all four walls using the "interlaced secondary air flow" approach illustrated in FIG. 3, the chimney Flow pattern was surprisingly attenuated and a tangential or swirling effect was induced in the boiler flow pattern which helps stabilise the air flow pattern.

Figure 4:
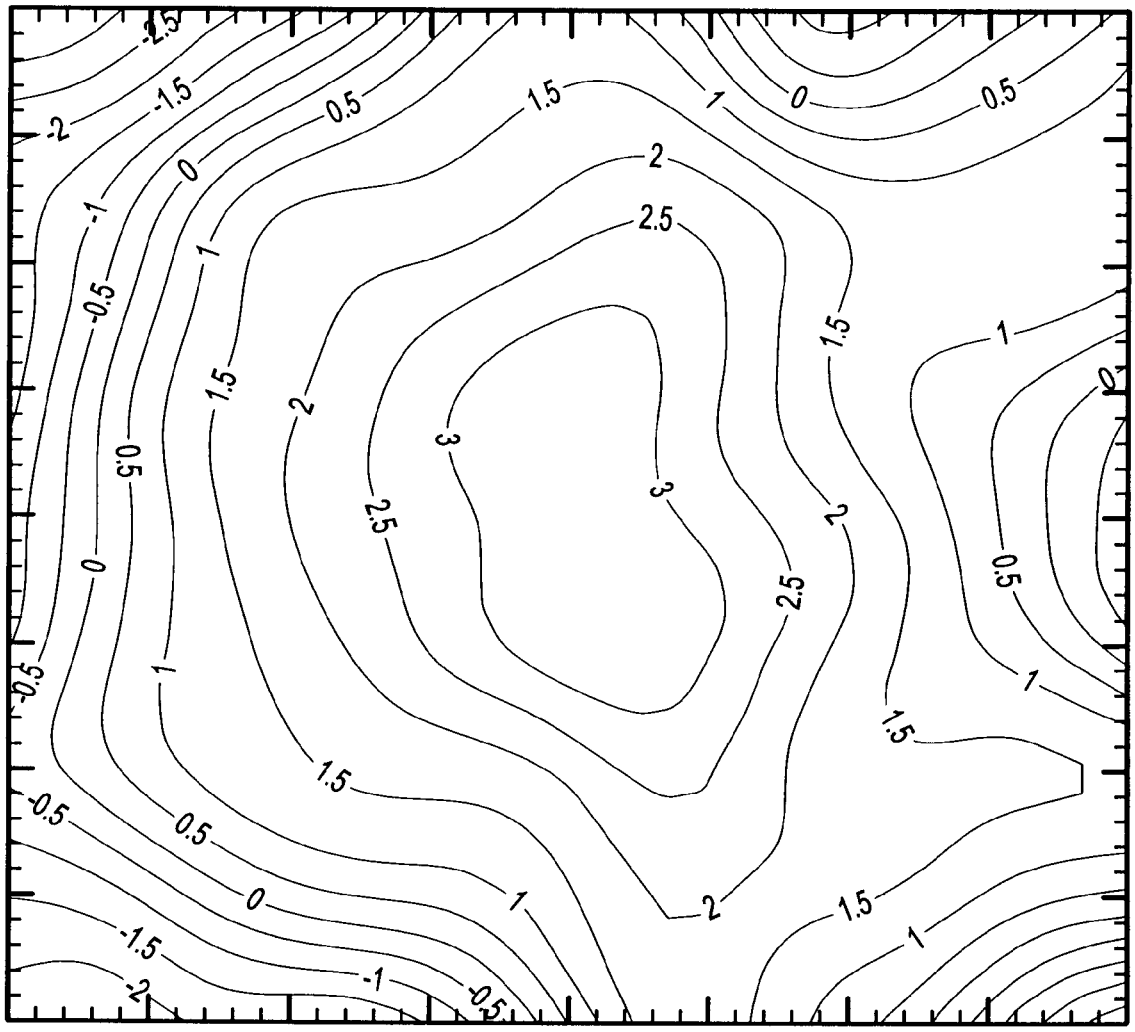
FIG. 4 shows how the contour plot of FIG. 1 is modified by optimizing the combustion air system in accordance with the invention.

FIG. 4 illustrates a contour plot of the cold air flow velocity profile at the liquor gun level in recovery boiler 'A' after the combustion air system in this boiler was optimized according to a preferred embodiment of our invention. First, the primary air flow was balanced to provide equal air flow from each of the four walls and nearly equal air flow from each port in each of the four walls. Secondly, the fully interlaced secondary air from the ports in the boiler's side walls was replaced with the four wall, "interlaced secondary air flow" approach of the present invention. Air flow through the air ports on all four walls of the boiler was "interlaced" as illustrated in FIG. 3 ("interlaced" secondary air flow").

Comparing FIGS. 1 and 4, a 33% reduction in peak gas velocities was achieved and the high velocity chimney was re-located to the centre of the boiler away from the liquor guns on each wall. As expected, liquor carryover and the rate of boiler plugging were reduced.

Figure 2A:
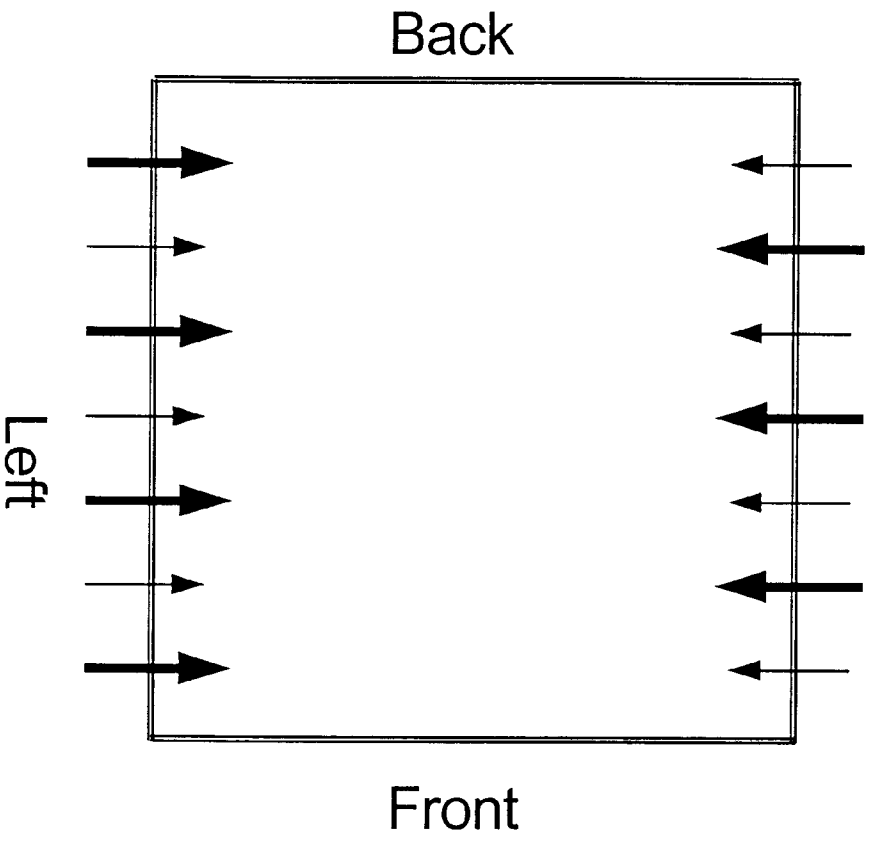
FIG. 2a (PRIOR ART)

Following optimization, there were no regions of downflow in the boiler as was observed in the prior art example, FIG. 2. When comparing the peak air velocities in FIGS. 4 and 3, one should note that no tertiary air was used during the measurements summarized in FIG. 1. As the tertiary air flow was 24% of the total air flow, the peak velocities in FIG. 4 would have been only about 75% of those shown if the tertiary air had also been shut off for this trial.

The mill's problems with unburnt carbon, high dregs in the green liquor and poor green liquor clarification disappeared as soon as the air system was optimized according to our invention. Both the liquor carryover and the resulting boiler plugging problems were greatly reduced. The frequency of boiler water washing was reduced from 8 to only 2 times per year and boiler throughput was significantly increased.

The optimized combustion air distribution between the walls of the boiler, and between the three levels of air injection is summarized in Table 3. Despite the existence of only a few secondary air ports on the front and back walls of this boiler, a substantial portion (~16%) of the secondary air was injected through these two walls without adversely affecting the furnace flow patterns.

TABLE 3

Summary of air flows distribution in Boiler A following optimization, according to the preferred embodiment of our invention.

| Wall | % of Primary Air | % of Secondary Air | % of Tertiary Air | % of Total Combustion Air |
|---|---|---|---|---|
| Front | 24.3 | 7.6 | 55.0 | 25.5 |
| Right | 25.5 | 40.2 | 0 | 24.9 |
| Rear | 25.1 | 8.3 | 45.0 | 23.6 |
| Left | 25.1 | 43.8 | 0 | 26.0 |
| % of Total Combustion Air | 39.2 | 36.9 | 23.8 | 100.0 |

By optimizing the combustion air supply to the boiler according to the embodiments of our invention, we have found that the recovery boiler efficiency and throughput were substantially increased while air emissions were minimized.

The implementation of an optimized combustion air flow, using the above principles and guidelines significantly increases both the mixing and the stability of the air flow patterns inside the boiler. In addition, an optimized air split, facilitated by the necessary air flow distribution measurements, helps to increase bed temperatures and chemical reduction efficiencies, while further attenuating the high velocity, "chimney effect", when it is present.

Example 4

The following example demonstrates how the data from the five key measurements are used to improve recovery boiler operation.

Mill C's number 1 recovery boiler was originally constructed and started operating in 1966. It is a Babcock and Wilcox furnace with a nameplate rating of 1640 tonnes or 3.6 million pounds of dry black liquor solids per day. The boiler was reconfigured in 1991 into a so-called, lowodour furnace, by replacing the direct contact evaporator with a concentrator and adding an economizer bank to the recovery boiler. At the same time, the original gas burners, liquor guns and secondary and tertiary air systems were upgraded. High-pressure, high-velocity nozzles were installed for the secondary and the tertiary air ports. Cold tertiary air is now introduced in an interlaced manner through windboxes located on the front and rear walls. Both the primary air and secondary air are preheated to 155° C. The majority of B&W recovery boilers at North American mills employ a very similar combustion air operating system.

Figure 5:
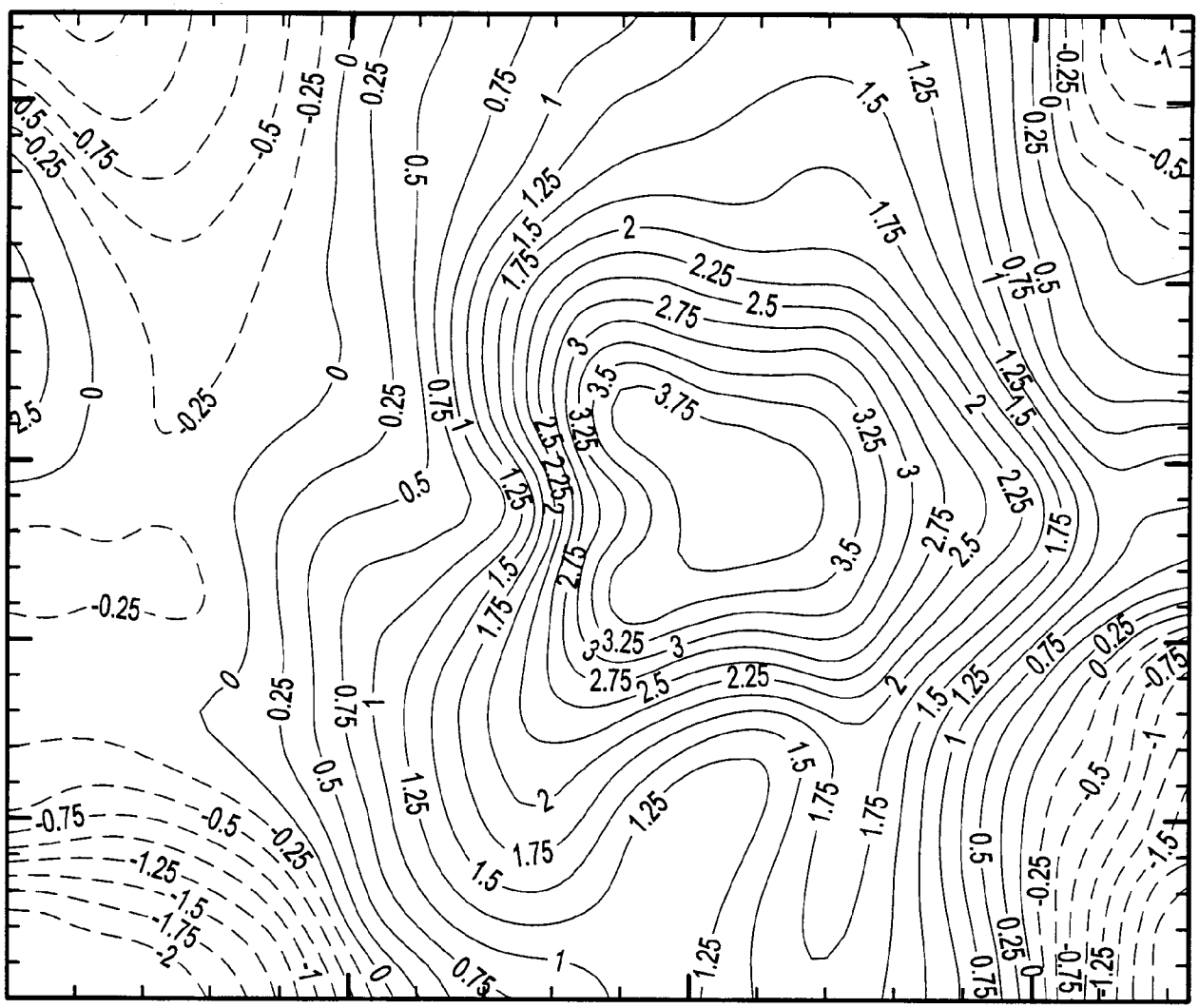
FIG. 5 is a contour port similar to FIG. 1 for a third recovery boiler.

Data generated from the key measurements that were made are documented in Table 4. The contour plot of the cold flow velocity measurements, FIG. 5, revealed an unbalanced air supply system producing a high-velocity chimney close to the right wall of the boiler. Almost half the boiler cross-section at the liquor gun level was in downflow. The proximity of the chimney to the liquor gun on the right wall of the boiler would be expected to increase liquor carryover and the rate of boiler plugging.

TABLE 4

Summary of air flows distribution in the number 1 recovery boiler at mill C before optimization.

| Wall | % of Primary Air | % of Secondary Air | % of Tertiary Air | % of Total Combustion Air |
|---|---|---|---|---|
| Front | 29.3 | 30.9 | 56.7 | 33.8 |
| Right | 18.6 | 16.9 | 0 | 15.3 |
| Rear | 29.1 | 32.8 | 43.3 | 32.7 |
| Left | 23.0 | 19.4 | 0 | 18.2 |
| % of Total Combustion Air | 42.6 | 43.6 | 13.8 | 100.0 |

Figure 6:
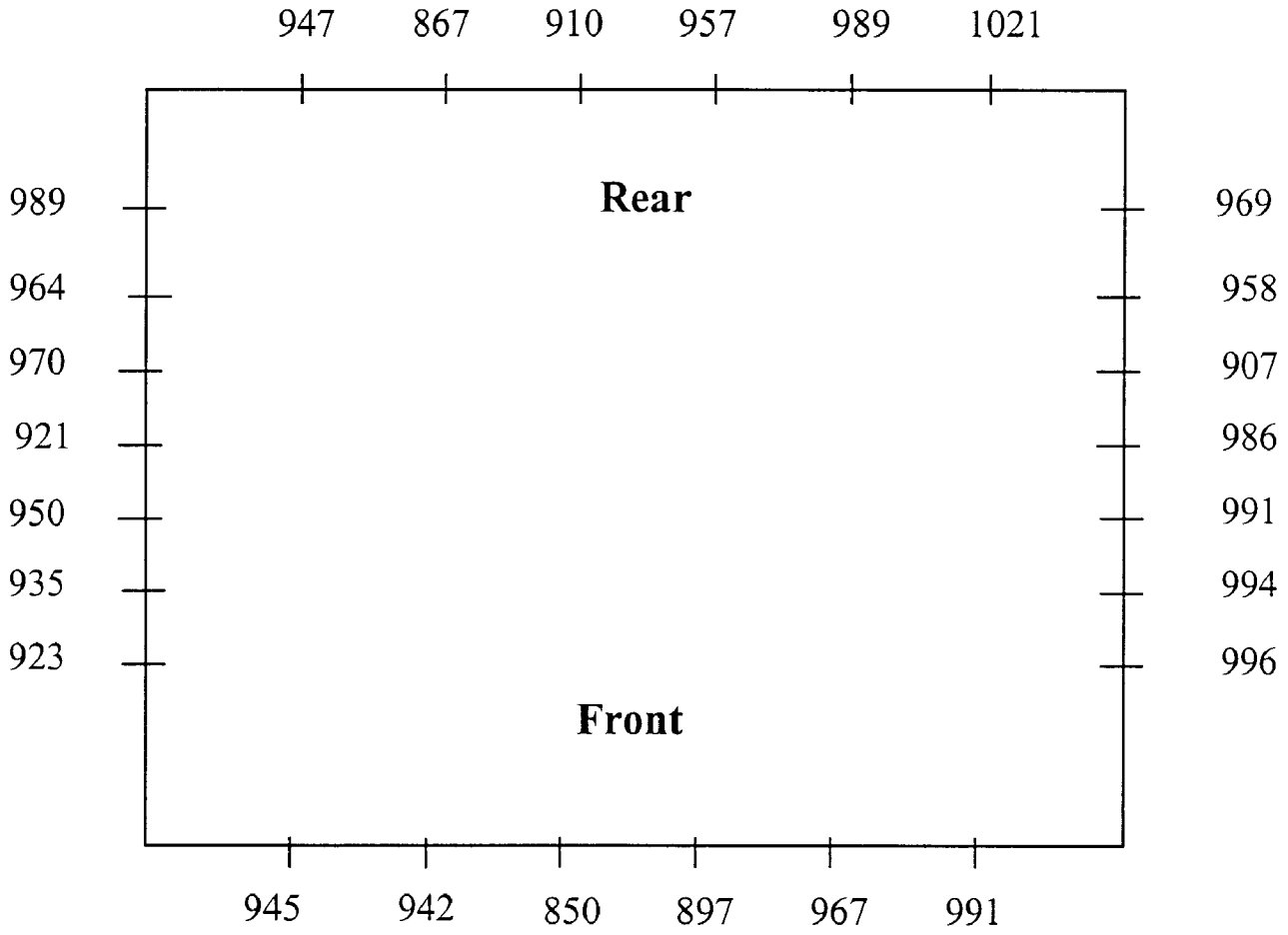
FIG. 6 illustrates bed temperatures in the third recovery boiler.

While the gas velocities measured at the furnace exit were not particularly high (7.4 to 7.8 m/s), gas temperatures were extremely high (930–990° C.), suggesting significant in-flight burning of entrained liquor droplets. The velocity-measuring probe was coated with a mixture of smelt and dried black liquor after each series of measurements, confirming a severe carryover problem. In addition, poor air distribution resulted in low and uneven char bed temperatures. As illustrated in FIG. 6, bed temperatures ranged from 850 to 1020° C. and averaged only 950° C., at least 100° C. lower than a normal target temperature. The low bed temperatures resulted in low reduction efficiencies, high TRS emissions and restrictions on the liquor-firing rate.

To reduce the strong chimney effect the air system was modified according to the disclosed embodiments of our invention. The primary air was re-balanced (four walls) and the "interlaced secondary air supply system" was implemented, as illustrated in FIG. 3, using a big (70–100% open) versus small (10–40% open) port arrangement and using the secondary air ports on all four walls of the boiler. The air distribution between the primary, secondary and tertiary air ports was redistributed to increase the char bed temperatures and the furnace reduction efficiency. The combustion air distribution between the walls of the boiler, and between the three levels of air injection, following air system optimization, is summarized in Table 5. The very high secondary air flow through the front wall is due to the presence of 4 large starter burners on that wall, versus only 2 on each of the rear and side walls.

TABLE 5

Summary of air flows distribution in the number 1 recover boiler at mill C following optimization, according to the teachings of this patent.

| Wall | % of Primary Air | % of Secondary Air | % of Tertiary Air | % of Total Combustion Air |
|---|---|---|---|---|
| Front | 28.7 | 37.6 | 56.4 | 37.8 |
| Right | 21.5 | 19.5 | 0 | 17.2 |
| Rear | 29.2 | 21.5 | 43.6 | 27.0 |
| Left | 20.6 | 21.4 | 0 | 18.0 |
| % of Total Combustion Air | 29.2 | 56.0 | 14.8 | 100.0 |

Figure 7:
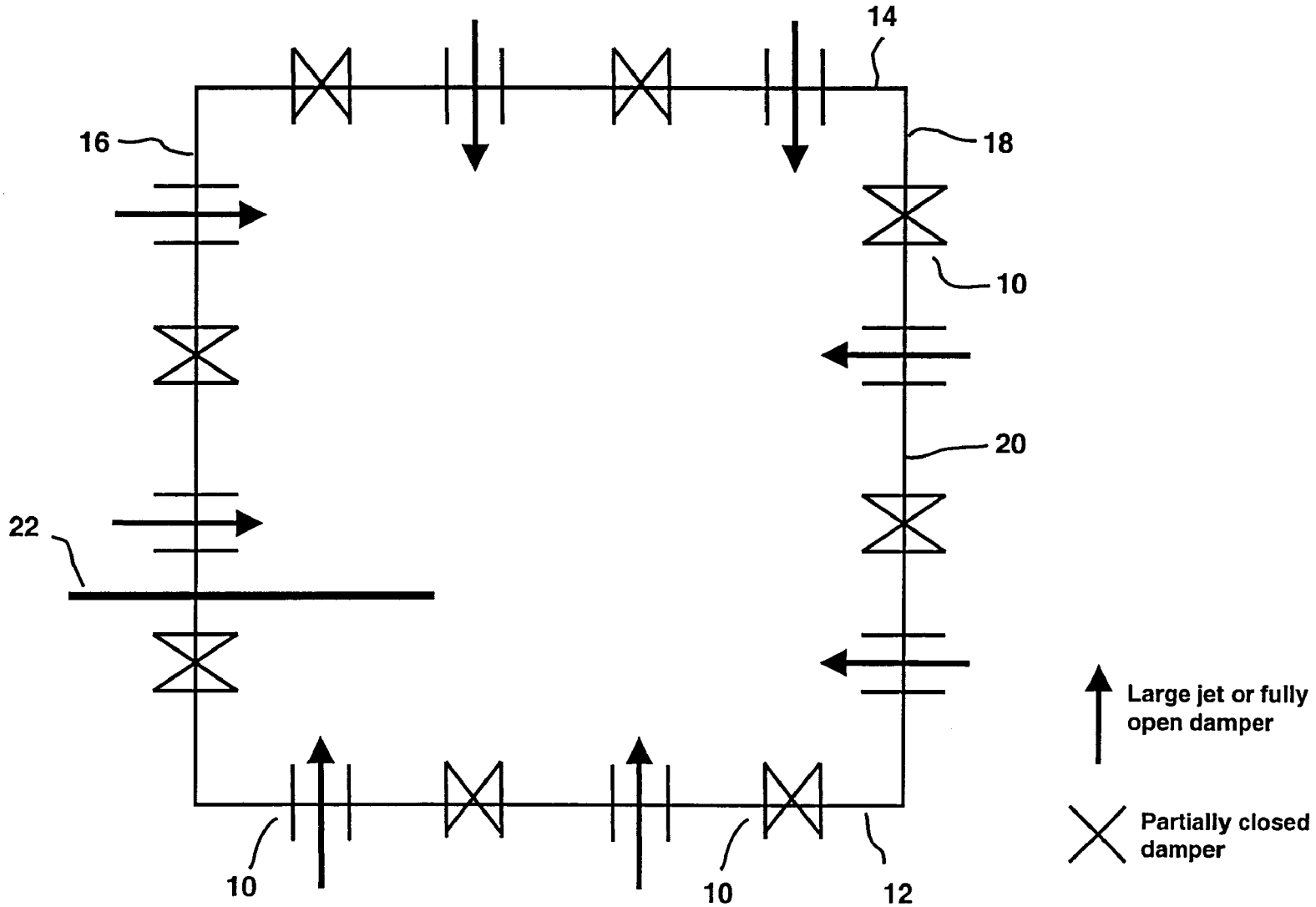
FIG. 7 is similar to FIG. 3 but shows that the ports are of identical size and with the same number of ports as each of the four walls; and additionally shows a measurement probe.

FIG. 7 is similar to FIG. 3 and schematically illustrates an embodiment in which the air ports 10 at the secondary air level are of identical size, with the same number of air ports in the front wall 12, back wall 14 and side walls 16 and 18 of the boiler 20, a measurement probe 22 extends through an opening in side wall 16, the partial interlacing is illustrated in the same manner as in FIG. 3.

Figure 8:
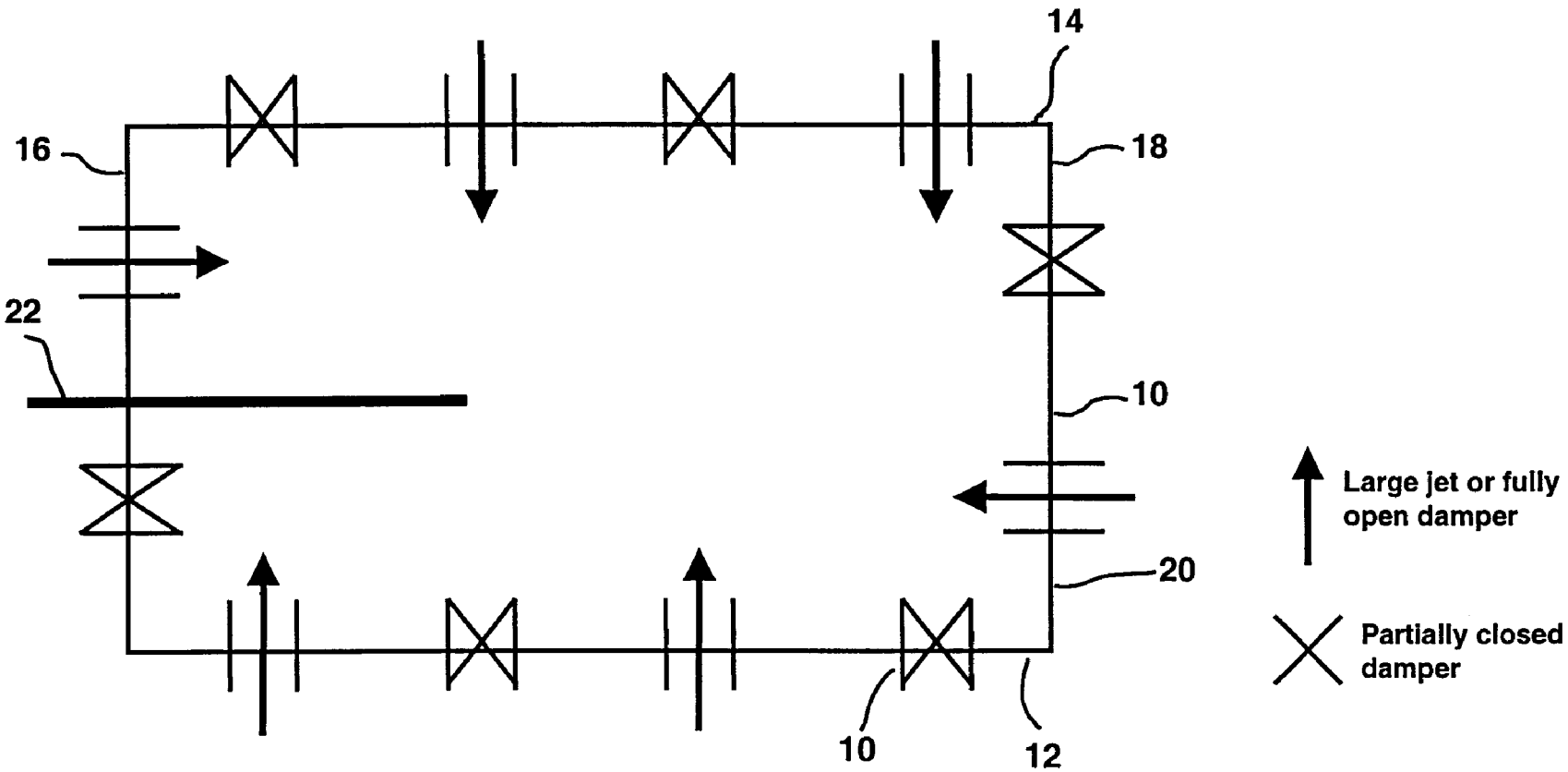
FIG. 8 is similar to FIG. 7 but with a ratio of ports on the front and rear walls to the ports on the side walls being 2:1.

FIG. 8 is similar to FIG. 7 but illustrates an embodiment in which the ratio of the number of air ports 10 in the front and back walls 12 and 14, to the number of air ports 10 in the said walls 16 and 18 is 2:1, and all the air ports 10 are of identical size as in FIG. 7 and the probe 22 extends through an opening in side wall 16, the partial interlacing is illustrated in the same manner as in FIGS. 3 and 7.

Following air system optimization, TRS emissions were immediately reduced from 750 to less than 10 mg/m$^3$, and the chemical reduction efficiency was increased from the high eighty percent range to in excess of ninety five percent. As a result of the reduced TRS emissions and within a week of the modifications, furnace loading was increased from 85 to 100% of the maximum continuous rating, resulting in a 17% increase in boiler throughput. Prior to optimization, rapid plugging in the convective heat transfer zone required the furnace to be water washed every 26 days; since optimization the furnace has ran for up to 90 days without any signs of plugging.

Similar benefits were also realized when the five key measurements were made and the combustion air system modified and re-balanced on the mill's CE/ABB recovery boiler. Very dramatic reductions in the water washing frequency and significant increases in liquor firing rates were documented, as summarized in Table 6. Increases in chemical reduction and thermal efficiencies have also been quantified in a number of other cases.

TABLE 6

Benefits of air system optimization observed in a number of recovery boilers.

| Mill | A | C, No. 1 | C, No. 2 | D | E |
|---|---|---|---|---|---|
| Type of Boiler | B & W | B & W | ABB | ABB | B & W |
| Water washes per year | 10 → 3 | 13 → 4 | 17 → 6 | 4 → 2 | 8 → 2 |
| Liquor firing rate | up 0.5% | up 17% | | up 5% | up 8% |

While this invention has been described with respect to particular embodiments and aspects thereof, it is apparent that other forms of the invention should generally be construed to cover obvious other forms and modifications which are within the true spirit and scope of the present invention.

What is claimed is:

1. A method of optimizing the combustion air system of a four wall recovery boiler having primary and secondary air flow elevations, said method comprising:

a) introducing air flow at the primary and secondary elevations through air ports on all four walls of the boiler; and b) interlacing air flow at the secondary elevation by alternately opening wide and partly closing port dampers of said air ports on each wall to establish wide open air ports and partially open air ports, so that wide open dampers on one wall oppose partly closed dampers on the opposite wall and wherein the air flow at the primary elevation is balanced by adjusting port dampers and windbox pressures so that the air flow is evenly distributed between opposing walls, between all four walls and, between individual air ports on each wall of the boiler at said primary elevation.

2. A method according to claim 1, wherein said air ports are of equal size, and said wide open dampers are 70 to 100% open and said partly closed dampers are 10–40% open.

3. A method according to claim 1, wherein said partly closed damper provides an air flow which is 10 to 50% of the air flow provided by an opposed wide open damper.

4. A method according to claim 3, wherein each partly closed damper provides an air flow which is 20 to 40% of the air flow provided by an opposed wide open air port.

5. A method according to claim 4, wherein said air ports are of different size.

6. A method as claimed in claim 1, wherein cold flow air velocity over a large cross section of the boiler is measured to enable optimizing of the air flow distribution.

7. A method as claimed in claim 1, wherein air flow through air ducts and windboxes at each elevation is measured to enable optimization of the air flow distribution.

8. A method as claimed in claim 1, wherein velocity and temperature of air flows within the boiler is measured during a step of auxiliary fuel firing to enable optimization of the air flow distribution.

9. A method as claimed in claim 1, wherein velocity and temperature of air flows within the furnace cavity ofthe boiler is measured during a liquor firing step to enable optimization of the air flow distribution.

10. A method as claimed in claim 1, wherein char bed temperature profiles and temperatures at different elevations in the boiler are measured to enable optimization of the air flow distribution.

11. A method as claimed in claim 1, wherein windbox pressure and air flows for one or more of said partially closed dampers at the secondary elevation is 10 to 70% of that of an opposed wide open damper so as to enhance interlacing of air flow at said secondary elevation.

12. A method as claimed in claim 11, wherein said windbox pressure and air flows for said one or more partially closed dampers is 10 to 40% of that of said opposed wide open dampers.

13. A method as claimed in claim 1, wherein at said primary elevation, air flow through one or more corner air ports in adjacent corners of said boiler is reduced by dampers in the corner air ports so as to attenuate strong interactions of air flows at said primary elevation from said one or more corner air ports.

14. A method, as claimed in claim 13, wherein the corner air ports are less than 6–8 feet from a corner and are contained on at least one windbox isolated closest to the corners of the boiler, and the air flow through ports remote from the corners are set equal so that the air flow at the primary elevation is evenly distributed between opposing walls and between all four walls of the boiler.

15. A method as claimed in claim 14, wherein the corner ports are contained on the windbox located closest to the corresponding corner of the boiler.

16. A method as claimed in claim 14, wherein the corner ports are contained on the two windboxes located closest to the corresponding corner of the boiler.

17. A method as claimed in claim 1, wherein said four walls comprise a pair of opposed side walls and opposed front and rear walls; and the total number of air ports in said side walls at said primary elevation is different from the total number of air ports in said front and rear walls; and air flow at said primary elevation is evenly distributed between opposed walls and opposed air ports.

18. A method as claimed in claim 17, wherein total air flow between opposed walls at said primary elevation is proportionate to wall length.

19. A method as claimed in claim 17, wherein total air flow between opposed walls at said primary elevation is proportionate to the number of air ports on each wall.

20. A method, as claimed in claim 17, wherein the boiler is rectangular in design.

21. A method, as claimed in claim 19, wherein the ratio of the number of air ports on the front and rear walls to the number of air ports on the side walls is up to 2:1 and each air port is identical in size.

22. A method, as claimed in claim 19, wherein the ratio of the number of air ports on the front and rear walls to the number of air ports on the sidewalls is 1:1 and each air port is identical in size.

23. A method as claimed in claim 17, wherein the opposed air ports in the boiler are different in size or number and the air flow to a single or small air port is 10 to 70% of the air flow through the opposed multiple air ports or large air port.

24. A method, as claimed in claim 23, wherein the air flow to a single or small air port is 10 to 40% of the air flow through the opposed multiple air ports or large air port.

25. A method as claimed in claim 23, wherein the opposed air ports in the boiler are identical in size and the windbox pressure for a partially open airport is 10 to 70% of the windbox pressure of the opposed wide open air port.

26. A method as claimed in claim 25, wherein said windbox pressure and air flow for a partially open air port is 10 to 40% of the windbox pressure and air flow of the opposed wide open air port.

27. A method as claimed in claim 1, wherein one or more of the following measurements are performed to enable optimization of the air flow distribution:

a) cold flow air velocity over a large cross-section of the boiler;

b) air flow through air ducts and windboxes at each elevation;

c) velocity and temperature of air flows within the furnace cavity during auxiliary fuel firing;

d) velocity and temperature of air flows within the furnace cavity during liquor firing; and e) char bed temperature profiles and temperatures at different elevations in the boiler.

28. A method of optimizing the combustion air system of a four wall recovery boiler having at least primary and secondary air flow elevations comprising:

a) introducing air flow at the primary and secondary elevations, through air ports in the four walls of the boiler;

b) interlacing air flow at the secondary elevations by alternately opening wide and partly closing port dampers of said air ports on each wall to establish wide open air ports and partially open air ports, so that a wide open damper on one wall opposes a partly closed damper on an opposite wall; and c) completely closing one or more of said partially closed dampers at said secondary elevations to minimize the size and peak velocity of a chimney flue.

29. A method according to claim 28, wherein step a) additionally comprises introducing air flow at a tertiary elevation through air ports on two opposed walls or all four walls of the boiler at said tertiary elevations; and step b) additionally comprises interlacing air flow at the tertiary elevations by alternately opening wide and partly closing port dampers of said air ports at said tertiary elevations to establish wide open air ports and partially open air ports so that a wide open damper on one wall opposes a partly closed damper on an opposite wall.

30. A method according to claim 29, wherein step c) additionally comprises completely closing one or more of said partially closed dampers at said tertiary elevations to minimize the size and peak velocity of the chimney flue.

31. A method of optimizing the combustion air system of a four wall recovery boiler having at least primary and secondary air flow elements comprising:

a) introducing air flow at the primary, secondary elevations through air ports on all four walls of the boiler, and b) interlacing air flow at the secondary elevation by alternate first and second air flows on each wall such that a first air flow from a wall opposes a second air flow from an opposite wall, wherein each second air flow is 10 to 50% of an opposing first air flow, and wherein step a) additionally comprises introducing air flow at a tertiary elevation through air ports on two opposed walls or all four walls of the boiler, at said tertiary elevations, and step b) additionally comprises interlacing air flow at the tertiary elevations by alternating first and second air flows on each wall at said tertiary elevations such that a first flow from a wall opposes a second air flow from an opposite wall at said tertiary elevations, such that the second air flow is 10 to 50% of that of an opposing first air flow.

32. A method according to claim 31, wherein each said second air flow is 20 to 40%, of the opposing first air flow.

* * * * *